US006960107B1

(12) United States Patent
Schaub et al.

(10) Patent No.: US 6,960,107 B1
(45) Date of Patent: Nov. 1, 2005

(54) MARINE TRANSMISSION WITH A CONE CLUTCH USED FOR DIRECT TRANSFER OF TORQUE

(75) Inventors: Gary J. Schaub, North Fond du Lac, WI (US); Thomas G. Theisen, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 11 days.

(21) Appl. No.: 10/826,544

(22) Filed: Apr. 16, 2004

(51) Int. Cl.[7] ..... B63H 20/14
(52) U.S. Cl. ..... 440/75; 192/21
(58) Field of Search ..... 440/75; 192/21, 192/51, 53, 311

(56) References Cited

U.S. PATENT DOCUMENTS

| | | | | |
|---|---|---|---|---|
| 3,608,684 A | | 9/1971 | Shimanckas | 192/20 |
| 3,842,788 A | | 10/1974 | Kroll | 115/34 R |
| 3,919,964 A | | 11/1975 | Hagen | 115/34 R |
| 3,943,790 A | | 3/1976 | Meyer | 74/417 |
| 4,189,038 A | * | 2/1980 | Hurst | 192/21 |
| 4,244,454 A | | 1/1981 | Bankstahl | 192/21 |
| 4,257,506 A | | 3/1981 | Bankstahl | 192/21 |
| 4,397,198 A | | 8/1983 | Borgersen et al. | 74/378 |
| 4,630,719 A | | 12/1986 | McCormick | 192/21 |
| 5,072,629 A | | 12/1991 | Hirukawa et al. | 74/851 |
| 5,509,863 A | | 4/1996 | Mansson et al. | 475/273 |
| 5,709,128 A | | 1/1998 | Skyman | 74/323 |
| 5,715,728 A | * | 2/1998 | Hallenstvedt et al. | 74/417 |
| 5,890,938 A | | 4/1999 | Eick et al. | 440/80 |
| 6,062,360 A | | 5/2000 | Shields | 192/21 |
| 6,523,655 B1 | | 2/2003 | Behara | 192/21 |

* cited by examiner

*Primary Examiner*—Jesus D. Sotelo
(74) *Attorney, Agent, or Firm*—William D. Lanyi

(57) ABSTRACT

A transmission for a marine propulsion system uses a cone clutch in such a way that, when in a forward gear position, torque is transmitted from an input shaft, or driving shaft, to an output shaft, or driven shaft, solely through the cone clutch. When in forward gear position, driving torque between the driving and driven shafts is not transmitted through any gear teeth. When in reverse gear position, torque is transmitted through an assembly of the bevel gears.

19 Claims, 6 Drawing Sheets

MARINE TRANSMISSION WITH A CONE CLUTCH USED FOR DIRECT TRANSFER OF TORQUE

BACKGROUND OF THE INVENTION

1. Field of the Invention

The present invention is generally related to a marine transmission and, more particularly, to a marine transmission in which a driving shaft and a driven shaft are aligned coaxially for transfer of torque directly through a cone clutch.

2. Description of the Prior Art

Those skilled in the art of marine propulsion systems are aware of many different types of transmissions that are used to provide the ability to allow the marine propulsion system to be operated in forward, neutral, and reverse gear positions. Some of these transmissions are located in the drive unit of a sterndrive marine propulsion system. Other types of transmissions are located between an engine, within the bilge of a marine vessel, and the transom of the marine vessel.

U.S. Pat. No. 3,608,684, which issued to Shimanckas on Sep. 28, 1971, describes a clutch for a marine propulsion device. The device affords reverse operation by rotation of the drive shaft housing about a vertical axis. It includes a clutch in the lower unit gear case for selectively engaging or disengaging the propeller shaft with the drive shaft. The clutch is responsive to axial movement of the drive shaft caused by moving a control handle accessible to the operator.

U.S. Pat. No. 3,842,788, which issued to Kroll on Oct. 22, 1974, describes a reversible transmission. The device includes a reversible clutch or transmission which includes a pair of facing drive gears rotatably mounted on a propeller shaft and having drive lugs, a shiftable driver mounted to the propeller shaft between the drive gears for axial movement relative to and in common rotation with the propeller shaft, a pair of clutch dogs rotatably carried on the propeller shaft driver and having drive lugs which are drivingly engageable with drive lugs on the corresponding drive gears, and means for selectively shifting the propeller shaft driver axially on the propeller shaft to drivingly engage a clutch dog with the corresponding drive gear.

U.S. Pat. No. 3,919,964, which issued to Hagen on Nov. 18, 1975, describes a marine propulsion reversing transmission with hydraulic assist. The device comprises a reversing transmission located in a propulsion unit and connecting a drive shaft to a propeller shaft and shiftable between neutral, forward drive, and rearward drive conditions, together with a mechanical linkage extending in the propulsion unit and connecting to the reversing transmission for operating the reversing transmission in response to movement of the mechanical linkage. It also comprises a hydraulic arrangement actuated in response to initial movement of the mechanical linkage for assisting in moving the mechanical linkage to operate the reversing transmission.

U.S. Pat. No. 3,943,790, which issued to Meyer on Mar. 16, 1976, discloses a marine outboard gear assembly. It features a constant drive of the meshing gears which transfer powers to the propeller-shaft axis and a selective spring-clutching direct to the propeller shaft. It utilizes the meshing gears for lubricant circulation as long as the engine is operating and whether or not the clutch is engaged and it reduces, to an absolute minimum, the drag and inertial effects operative upon the propeller shaft when the boat is moving in the declutched condition.

U.S. Pat. No. 4,244,454, which issued to Bankstahl on Jan. 13, 1981, discloses a cone clutch. The cone clutch has its forward and reverse clutch gears supported by bearings mounted on the housing with a main shaft supported by bearings mounted on the housing in the same planes as the forward and reverse gear bearings. The male cone member is biased by two springs, each encircling cam faces on the member and bearing against the forward and reverse clutch gears, respectively, to bias the cone member away from its center or neutral position.

U.S. Pat. No. 4,257,506, which issued to Bankstahl on Mar. 24, 1981, discloses a shifter linkage for a cone clutch. The male cone member of a cone clutch mechanism has two springs, each encircling cam faces on the male cone member and bearing against the forward and reverse clutch gears, respectively, to bias the cone member away from its center or neutral position toward either the forward or reverse clutch gear. An eccentric roller on the shift actuator shaft engages with a circumferential groove in the male cone member to provide a vibrating force against the member for shifting.

U.S. Pat. No. 4,397,198, which issued to Borgersen et al. on Aug. 9, 1983, describes a marine transmission assembly system. A reversing double cone clutch drive assembly for a boat comprising a horizontal input shaft, a vertical intermediate output shaft, a first housing provided with an opening in a side wall opposite to the input shaft and an opening in a bottom wall through which the lower end of the intermediate output shaft is exposed, and selectable gear transmission subassemblies attachable to the clutch drive assembly are described. Each subassembly includes a second housing with a generally horizontal wall for engaging the bottom wall, the second housing carrying a bearing which mounts on an output shaft driven through gear means by the intermediate output shaft.

U.S. Pat. No. 4,630,719, which issued to McCormick on Dec. 23, 1986, discloses a torque aided pulsed impact shift mechanism. A cone clutch sleeve on a main shaft is moved axially between forward and reverse counter rotating gears by a yoke having mirror image oppositely tapered cams on opposite sides thereof which are selectively rotatable to engage eccentric rings on the forward and reverse gears. This engagement drives the yoke away from the one engaged gear and toward the other gear to, in turn, drive the clutch sleeve out of engagement with the one gear such that torque applied through the cam engaged gear ring assists clutch disengagement.

U.S. Pat. No. 5,072,629, which issued to Hirukawa et al. on Dec. 17, 1991, describes a shift assisting system. The mechanism for assisting the shifting of a dog clutch of a marine transmission by reducing the engine speed is described. The requirement for engine speed reduction is sensed by a pressure sensitive conductive rubber type pressure sensing switch contained within the inner connection between the operator and the dog clutch.

U.S. Pat. No. 5,509,863, which issued to Mansson et al. on Apr. 23, 1996, describes a transmission device for boat motors. The transmission comprises an input shaft, a reversing mechanism and an output shaft. The reversing mechanism is comprised by a right angle bevel gearing with two bevel gears, which are freely rotatably mounted on an intermediate shaft and engaged with a bevel gear on the input shaft. The bevel gears each cooperate with an individual clutch respectively, by which one of the bevel gears can be locked to the intermediate shaft. The clutches are placed outside the bevel gearing. The clutches are wet clutches compressible by a piston that moves in a cylinder which in turn communicates with a hydraulic pump driven by one of the input and intermediate shafts.

U.S. Pat. No. 5,709,128, which issued to Skyman on Jan. 20, 1998, describes reversing gears for boats. A reversing gear for boats, comprising a displaceable engagement sleeve with a V-shaped groove is described. There extends a gear selector into the V-shaped groove in the form of a dog on a pin moveable in the axial direction of the engaging sleeve. The pin is eccentrically mounted in a rotatable sleeve. A ball and socket joint between the dog and the pin assures that the dog will retain its orientation and contact surface in the groove during the shifting movement.

U.S. Pat. No. 5,890,938, which issued to Eick et al. on Apr. 6, 1999, discloses a marine counter rotational propulsion system. A system with counter rotating propellers is provided with the capability of causing the propellers to rotate at different speeds. A first gear is attached to an inner propeller shaft and a second gear is attached to an outer propeller shaft. The inner and outer propeller shafts are arranged in coaxial and concentric relation for rotation about an axis of rotation. A drive shaft is connected to a pinion gear which engages the teeth of the fore and aft gears at different effective diameters. The pinion gear meshes with a first plurality of gear teeth on a beveled surface of the fore gear while a second set of gear teeth of the pinion gear mesh with a second plurality of gear teeth on a beveled surface of the aft gear. Because of the different effective diameters of the first and second pluralities of gear teeth, the inner and outer shafts rotate at different speeds.

U.S. Pat. No. 6,062,360, which issued to Shields on May 16, 2000, discloses a synchronizer for a gear shift mechanism for a marine propulsion system. A synchronized gear shift mechanism is provided for a marine propulsion system. Using a hub and a sleeve that are axially moveable relative to an output shaft but rotationally fixed to the shaft and to each other, the gear shift mechanism uses associated friction surfaces to bring the output shaft up to a speed that is in synchronism with the selected forward or reverse gear prior to mating associated gear tooth surfaces together to transmit torque from an input shaft to an output shaft. The friction surfaces on the forward and reverse gears can be replaceable to facilitate repair after the friction surfaces experience wear.

U.S. Pat. No. 6,523,655, which issued to Behara on Feb. 25, 2003, discloses a shift linkage for a marine drive unit. The linkage is provided with a groove that is aligned along a path which is nonperpendicular to an axis of rotation of the shift linkage. The groove, and its nonperpendicularity to the axis of rotation, allow a detent ball to smoothly roll or slide along the groove. This relationship helps to maintain the shift linkage in a desired vertical position as it passes from one gear selection position to another.

The patents described above are hereby expressly incorporated by reference in the description of the present invention.

Most current sterndrive systems use a transmission to shift between forward, neutral, and reverse gears in one of four basic ways. A complete hydraulic clutch pack style of transmission utilizes a planetary gear set for reverse. This type is mounted directly to the engine in front of the sterndrive U-joint. It tends to be inefficient due to the use of a hydraulic pump, clutch packs, and the losses of the large planetary assembly structure. This type of transmission also tends to be relatively large and requires more space in a marine vessel than that which is typically available in many types of boats.

Another style of transmission is intentionally designed to be shifted only when the engine is inactive. This type typically uses a dog clutch and is used primarily for racing applications.

A cone clutch style of transmission is usually built into the upper drive shaft housing of a sterndrive system. They typically have an input pinion meshing with two gears, one above and one below the center line of the input pinion rotation, which rotates about the vertical drive shaft axis. These gears are rotated in opposite directions and a cone clutch engages one gear or the other to achieve forward or reverse gear selection. Full engine power is transmitted through one of the gear sets at all times that the engine is operating. The requirements of the gears are typically high because of the loading cycle that they must handle. Ideally, the gear geometry could be optimized, but the requirement that the cone clutch be mounted between the two driven gears limits this optimization.

Another type of transmission that is often used is typically located in the gear case. It is similar in function to the cone clutch, except that a dog clutch is used, and it is located for axial movement on the propeller shaft. A pinion drives two gears at all times. These gears are located on the propeller shaft and rotate in opposite directions. Forward and reverse gear positions are achieved by engaging the dog clutch to one gear or the other. The teeth of the dog clutch must be aligned before it can be engaged. When the mating components are spinning at different speeds, this can lead to excessive noise until the teeth actually engage with each other.

When cone clutches are used, as described above, they are typically contained in the drive shaft housing. All of the power from the engine is transmitted through a pinion gear to the forward and reverse gears which must run constantly because of their constant mesh with the pinion gear. These applications typically maintain an oil level in the transmission that submerges the mesh of at least one gear.

It would be significantly beneficial if torque could be transmitted from a driving shaft to a driven shaft, in forward gear, without having to transmit torque through meshed pinion and bevel gears. It would also be significantly beneficial if the gear meshes were not constantly submerged in gear oil. These features would improve operating efficiency and reduce the amount of heat generated by the transmission. In addition, these features would also allow the transmission to be more compact than known transmissions.

SUMMARY OF THE INVENTION

A transmission for a marine propulsion system, in accordance with a preferred embodiment of the present invention, comprises a first shaft supported for rotation about a first axis and a second shaft supported for rotation about a second axis. It comprises a clutch which is alternately moveable into first and second positions. When in the first position, the clutch is disconnected from torque transmitting association with the first and second shafts and the first and second shafts are disconnected from torque transmitting relation with each other. When the clutch is in the second position, it is connected in torque transmitting association between the first and second shafts, with torque being transferred from the first shaft to the second shaft solely through the clutch.

The present invention can further comprise a first bevel gear attached to the first shaft and rotatable about the first axis and a second bevel gear which is rotatable about the second axis. An intermediate bevel gear is disposed in gear tooth meshing relation between the first and second bevel gears. The clutch can be alternately moveable into a third position. When in the third position, the clutch is connected in torque transmitting association between the second bevel gear and the second shaft. The first and second shafts are connected in torque transmitting relation with each other through the first bevel gear, the intermediate bevel gear, the second bevel gear, and the clutch when the clutch is in the third position.

In a particularly preferred embodiment of the present invention, the first and second axes are generally parallel to each other and, in a most preferred embodiment, the first and second axes are coaxial with each other. The intermediate bevel gear is rotatable about a third axis which is generally perpendicular to the first and second axes. The first shaft is connected in torque transmitting relation with a crankshaft of the engine and the second shaft is connected in torque transmitting relation with a propeller shaft of the marine propulsion system. The clutch is connected in threaded engagement with the second shaft through a set of helical splines. In a preferred embodiment, the clutch is a cone clutch.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
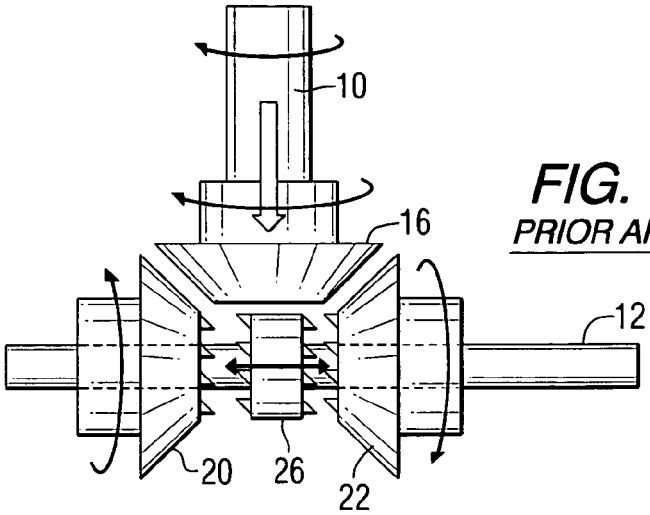
FIG. 1 PRIOR ART
FIGS. 1–3 show various positions of a dog clutch transmission.

Throughout the description of the preferred embodiment of the present invention, like components will be identified by like reference numerals.

FIG. 1 shows a generally known type of marine transmission that provides an input shaft 10, or driving shaft, and an output shaft 12, or driven shaft. The input shaft is attached to a first gear 16 which is used as a pinion gear. A forward gear 20 and a reverse gear 22 are disposed in constant meshing association with the first gear 16. It should be understood that in the illustrations of FIGS. 1–8, the bevel gears are shown spaced slightly apart for the purpose of clearly distinguishing these components from one another. However, it should also be clearly understood that these gears are bevel gears which are disposed in continuous tooth meshing association with each other.

With continued reference to FIG. 1, it can be seen that rotation of the first gear 16, or driving gear 16, causes continual rotation of both the forward 20 and reverse 22 bevel gears. The forward and reverse gears, 20 and 22, rotate in opposite directions, as illustrated by the arrows. A dog clutch 26 is moveable in an axial direction, which is horizontal in FIG. 1, between the forward and reverse bevel gears. It moves relative to the output shaft 12 and is associated with the output shaft, in threaded association, through a set of straight splines in a manner which is well known to those skilled in the art of marine transmissions. With the dog clutch 26 in the position shown in FIG. 1, neither the forward 20 nor reverse 22 bevel gears are rigidly attached to the second shaft 12, or driven shaft. As a result, the first and second bevel gears, 20 and 22, rotate about their axes of rotation without affecting the output shaft 12.

Figure 2:
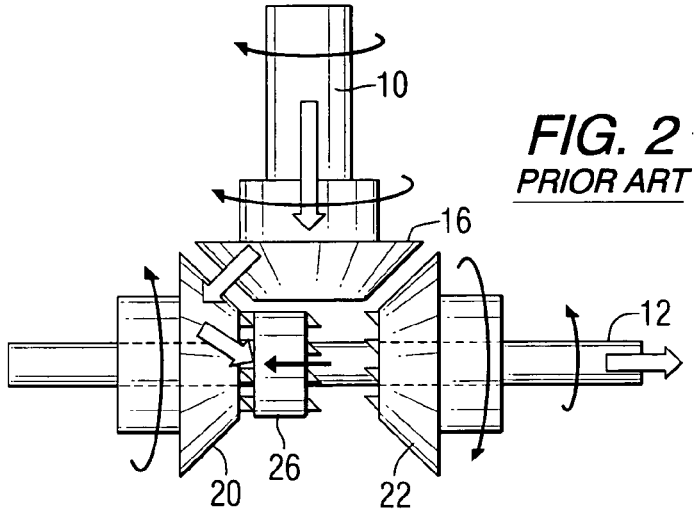
FIG. 2 PRIOR ART

FIG. 2 shows the apparatus illustrated in FIG. 1, but with the dog clutch 26 moved toward the left to engage its teeth with teeth of the forward bevel gear 20. This engagement of the dog clutch teeth causes the dog clutch 26 to rotate in unison with the forward bevel gear 20. Since the dog clutch 26 is associated in threaded engagement with the output shaft 12, because of the straight spline association with that shaft, the output shaft 12 rotates in unison with the forward gear 20 and the dog clutch 26. The rotational arrows indicate that the output shaft 12 rotates in the same direction as the forward bevel gear 20.

Figure 3:
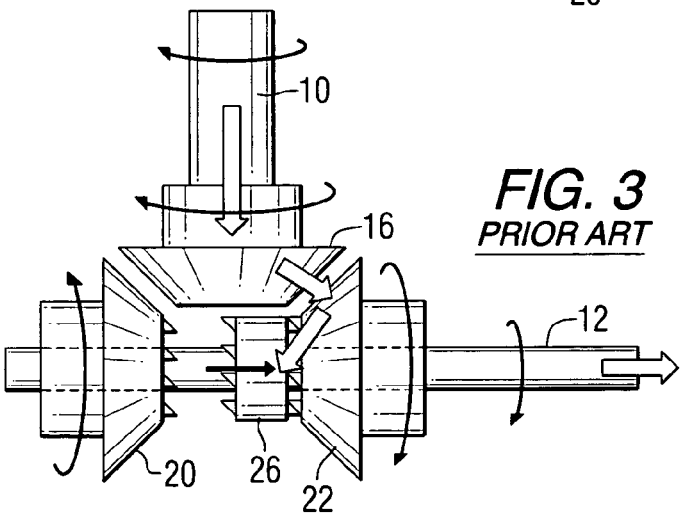
FIG. 3 PRIOR ART

FIG. 3 illustrates the opposite condition, wherein the dog clutch 26 is moved toward the right and into tooth engagement association with the reverse bevel gear 22. As a result, the dog clutch 26 rotates in unison with the reverse bevel gear 22 and, because of the threaded association caused by the straight spline connection to the output shaft 12, the second shaft 12 rotates in unison with the reverse bevel gear 22.

With reference to FIGS. 1–3, it can be seen that axial movement of the dog clutch 26 to its limits of travel causes either the forward bevel gear 22 or the reverse bevel gear 22 to rotate in unison with the dog clutch 26 to select the rotational direction of the output shaft 12.

With reference to FIG. 2, the large arrows represent the transmission of torque. As shown in FIG. 2, torque is transmitted from the first shaft 10, or input shaft, to the first bevel gear 16 and then to the forward bevel gear 20 because of its tooth mesh association with the first bevel gear 16. The forward bevel gear 20 then transmits torque to the dog clutch 26 which, in turn, transmits torque to the output shaft 12.

With reference to FIG. 3, the transfer of torque is from the first shaft 10 to the first bevel gear 16 and then, because of the tooth mesh association, to the reverse bevel gear 22 and to the dog clutch 26 which transmits the torque to the output shaft 12.

Figure 4:
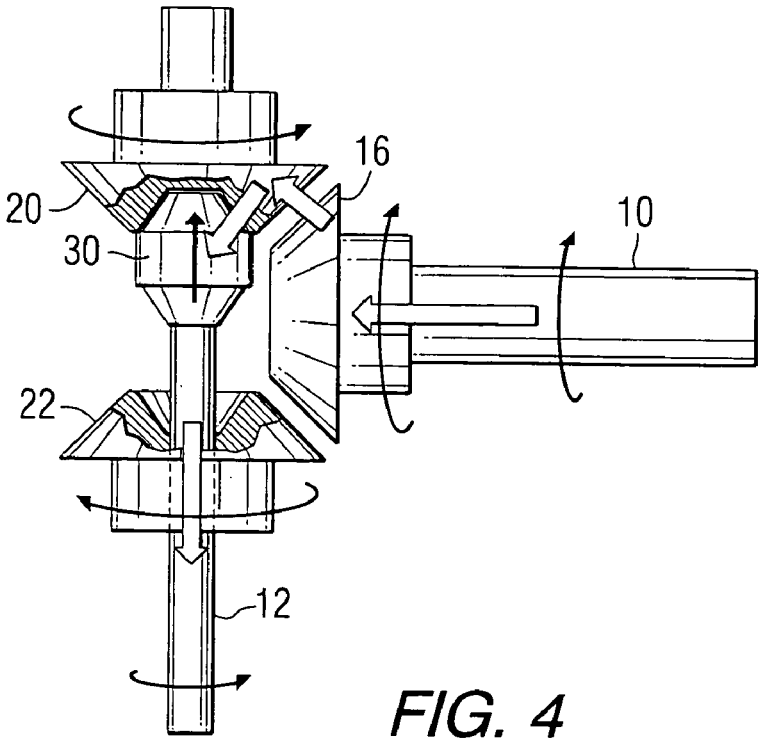
FIGS. 4 and 5 show two positions of a cone clutch transmission.

FIG. 4 shows a generally known type of marine transmission that utilizes a cone clutch 30. When the cone clutch 30 is in a central position between the forward 20 and reverse 22 bevel gears, no torque is transferred from either of those two bevel gears to the output shaft 12. When the cone clutch 30 is moved upward, as shown in FIG. 4, it places the forward gear 20 in torque transmitting relation with the output shaft 12, through the cone clutch 30 which is provided with helical splines that are engaged with matching helical splines formed on the output shaft 12. A frictional connection between the upper portion of the cone clutch 30 and the mating frictional surface formed in the bevel gear 20 connects those two in frictional association with each other. This causes the cone clutch 30 to begin to rotate in unison with the forward bevel gear 20 and this, in turn, further urges the cone clutch 30 in an upward direction and into more intimate frictional contact with the forward bevel gear 20. When in this position, as shown in FIG. 4, torque is transmitted from the input shaft 10, through the pinion gear 16, or first bevel gear, to the forward bevel gear 20, and to the output shaft 12 through the cone clutch 30.

Figure 5:
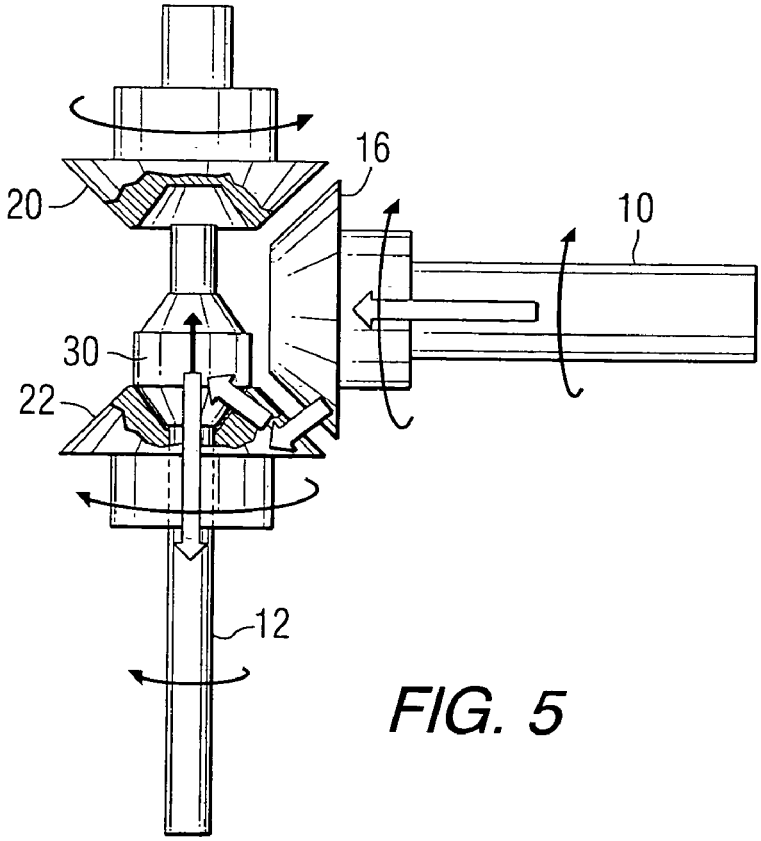

In FIG. 5, the cone clutch 30 is moved downwardly into frictional contact with the opening formed in the reverse bevel gear 22. In a manner generally similar to that described above in conjunction with FIG. 4, the helical splines urge the cone clutch 30 downwardly into more intimate frictional contact with the opening of the reverse bevel gear 22 and torque is transmitted from the input shaft 10, through the first bevel gear 16, to the reverse bevel gear 22, to the cone clutch 30, and finally to the output shaft 12.

FIGS. 1–5 show the way in which two known types of marine transmissions operate. FIGS. 1–3 illustrate the operation of a dog clutch system and FIGS. 4–5 illustrate a cone clutch system. It can be seen that in all of the positions illustrated in FIGS. 2–5, torque is transmitted through the meshing teeth of the bevel gears in both forward and reverse directions.

Figure 6:
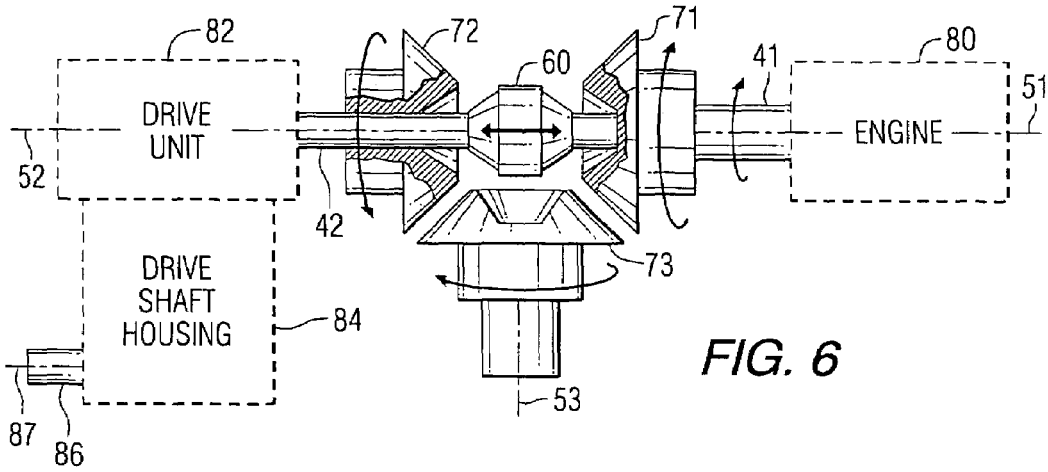
FIGS. 6–8 show the present invention in a simplified set of representations to illustrate its alternate positions of its cone clutch.

FIG. 6 is a schematic representation of the present invention which is purposely simplified for clarity. A first shaft 41 is supported for rotation about a first axis 51. A second shaft 42 is supported for rotation about a second axis 52. A clutch 60 is alternately moveable into a first position and a second position. The first position will be described below in conjunction with FIG. 7 and the second position will be described below in conjunction with FIG. 8. A first bevel gear 71 is attached to the first shaft 41 and is rotatable about the first axis 51. A second bevel gear 72 is rotatable about the second axis 52, but is free to rotate independently of the second shaft 42 when the clutch 60 is in a central position as shown in FIG. 6. An intermediate bevel gear 73 is disposed in gear tooth meshing association between the first and second, 71 and 72, bevel gears. As described above, the bevel gears are in tooth meshing association with each other even though they are shown to be spaced slightly apart for purposes of clarity in the illustrations. FIG. 6 illustrates the clutch 60 moved to the first position, FIG. 7 illustrates the clutch 60 moved to its second position, and FIG. 8 shows the clutch 60 moved to a third position.

With continued reference to FIG. 6, an engine 80 has a crankshaft connected in torque transmitting association with the first shaft 41, or driving shaft. A drive unit 82, which is located aft of the transom of a marine vessel, is connected to the second shaft 42, or driven shaft. A drive shaft housing 84 is illustrated and propeller shaft 86 is shown supported for rotation about a propeller shaft axis 87. Those skilled in the art of marine propulsion systems are well aware of the various interconnections between the second shaft 42 and the propeller shaft 86 within the drive shaft housing 84 and drive unit 82. Therefore, these known interconnections will not be described in detail herein.

The engine 80 is contained within the bilge of a marine vessel, with its crankshaft in torque transmitting association with the first shaft 41. When the clutch 60 is in the position shown in FIG. 6, no torque is transmitted from the first shaft 41 to the second shaft 42. However, it should be understood that the first, second, and intermediate bevel gears, 71–73, all rotate because of their tooth mesh association with each other and because of the rigid attachment between the first bevel gear 71 and the first shaft 41. However, when the clutch 60 is not in frictional contact with either the first or second bevel gears, 71 or 72, torque is not transferred from either of these two bevel gears to the second shaft 42, or driven shaft.

Figure 7:
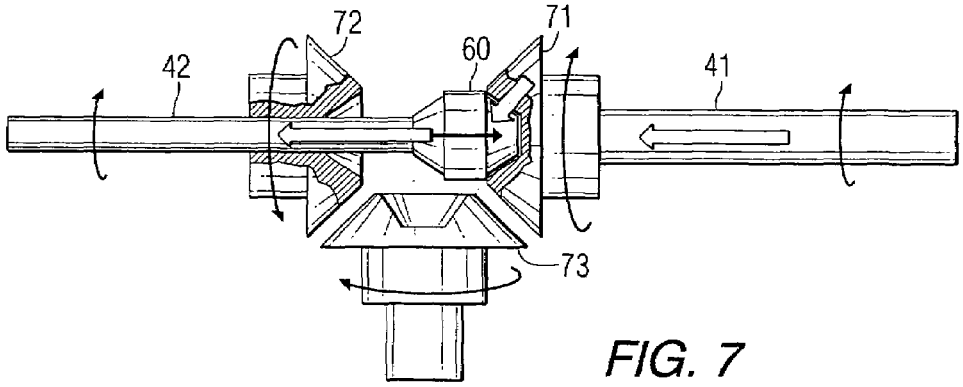
Figure 8:
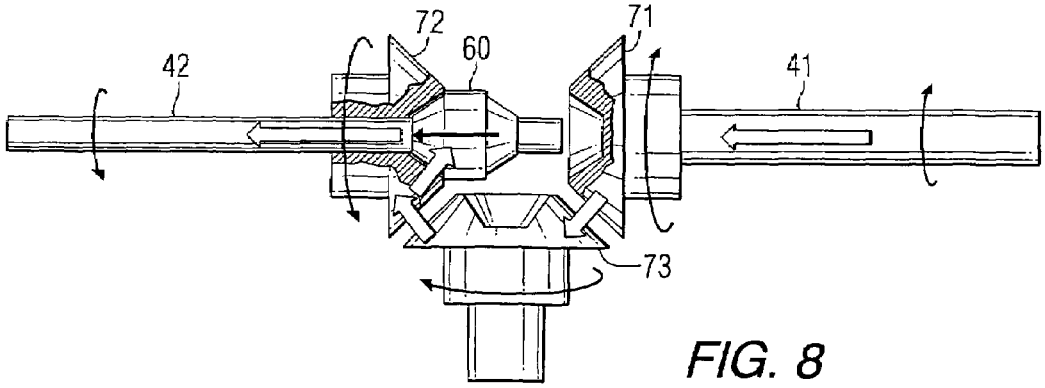

FIG. 7 shows the clutch 60 moved into frictional engagement with the first bevel gear 71. For purposes of clarity and simplicity, the engine 80, the drive unit 82, the drive shaft housing 84, and the propeller shaft 86 are not illustrated in FIG. 7.

When the clutch 60 is moved toward the right as shown in FIG. 7, it moves into frictional engagement with the frictional surfaces formed within the first bevel gear 71. This, in turn, urges the clutch 60 into further frictional engagement because of the action of the helical splines which connect the clutch 60 to the output shaft, or second shaft 42. When in the position shown in FIG. 7, torque is transmitted from the first shaft 41 to the first bevel gear 71 because of its rigid attachment to the first shaft. From there, torque is transmitted from the first bevel gear 71, through the contacting frictional surfaces, to the cone clutch 60. Since the cone clutch 60 is in tooth meshing relation with the second shaft 42 because of the helical splines, torque is transmitted from the cone clutch 60 to the second shaft 42. It is important to note that, although the first, second, and intermediate bevel gears are all continuously rotating because of their tooth mesh association with each other, torque is not transmitted through either the second bevel gear 72 or the intermediate bevel gear 73. In fact, torque is not transmitted through any meshing teeth of any bevel gear. Instead, all of the torque provided by the driving shaft, or first shaft 41, is transmitted through the frictional engagement between the first bevel gear 71 and the clutch 60 and through the helical spline connection between the clutch 60 and the driven shaft, or second shaft 42. When in the position shown in FIG. 7, the inertial resistance to rotation provided by the second shaft 42, in combination with the helical spline connection between the clutch 60 and the second shaft 42, urges the clutch 60 into more intimate frictional contact with the first bevel gear 71 to more effectively transmit the torque from the first shaft 41 to the second shaft 42.

When the clutch 60 is moved into its third position, as shown in FIG. 8, its frictional surface moves into contact with a mating frictional surface formed in the second bevel gear 72. In combination with the action of the helical splines, as described above, the inertial resistance provided by the second shaft 42 causes the clutch 60 to move into more intimate frictional contact with the second bevel gear 72. The second bevel gear 72, as shown, rotates in a direction opposite to the first shaft 41 and to the first bevel gear 71. This is the result of the intermediate bevel gear 72 connected between the first and second bevel gears, 71 and 72. As a result, torque is transmitted from the first shaft 41 to the first bevel gear 71, because of its rigid attachment to the first shaft, and then, through the tooth connection, to the intermediate bevel gear 73. The tooth connection between the intermediate bevel gear 73 and the second bevel gear 72 causes the second bevel gear 72 to rotate in the direction shown. When the clutch 60 is in intimate frictional contact with the second bevel gear 72, it then transmits the torque through the clutch 60 to the second shaft 42. Throughout FIGS. 1–8, the larger broad arrows represent the path that torque is transmitted. The smaller line arrows represent direction of movement.

Figure 9A:
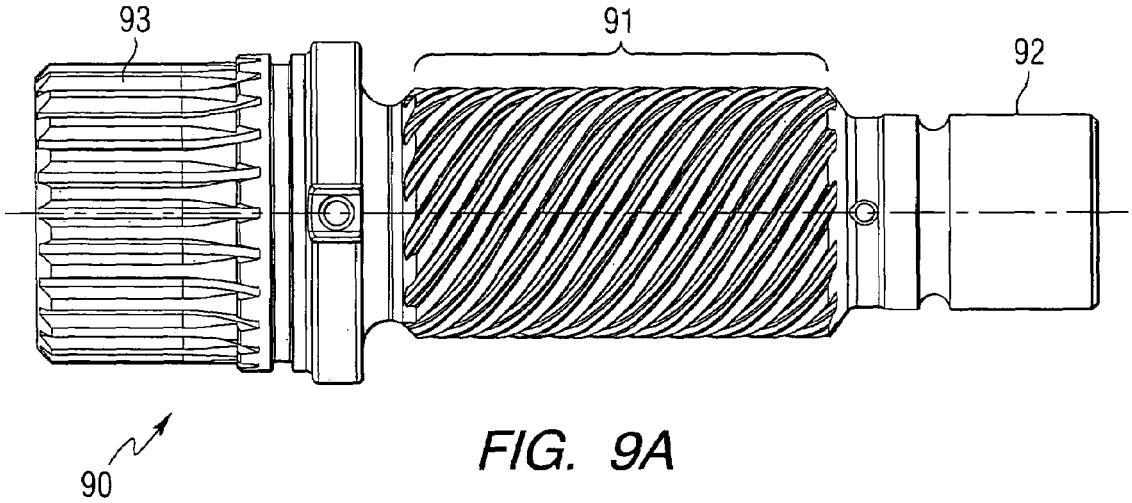
FIGS. 9A and 9B are side and section views, respectively, of an intermediate shaft used in a preferred embodiment of the present invention.
Figure 9B:
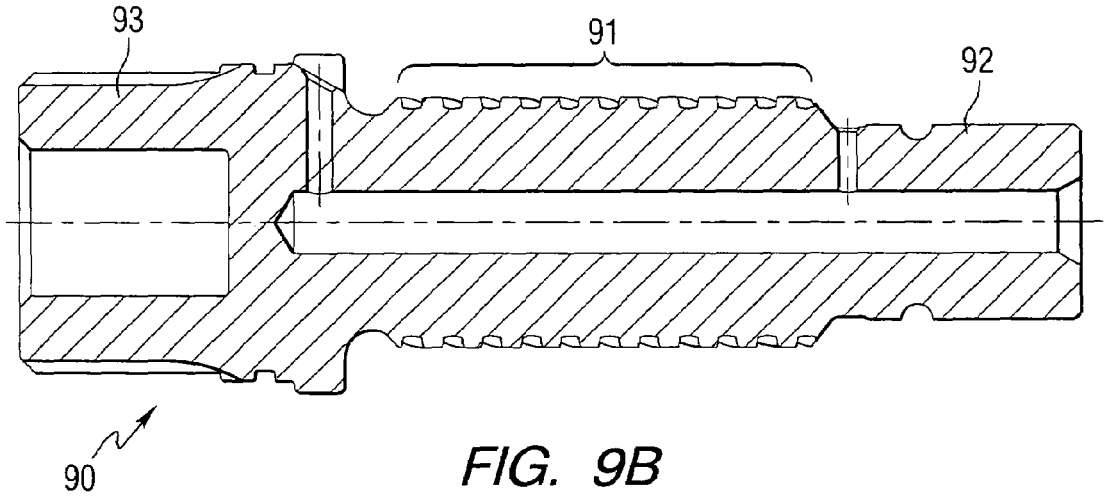
Figure 10:
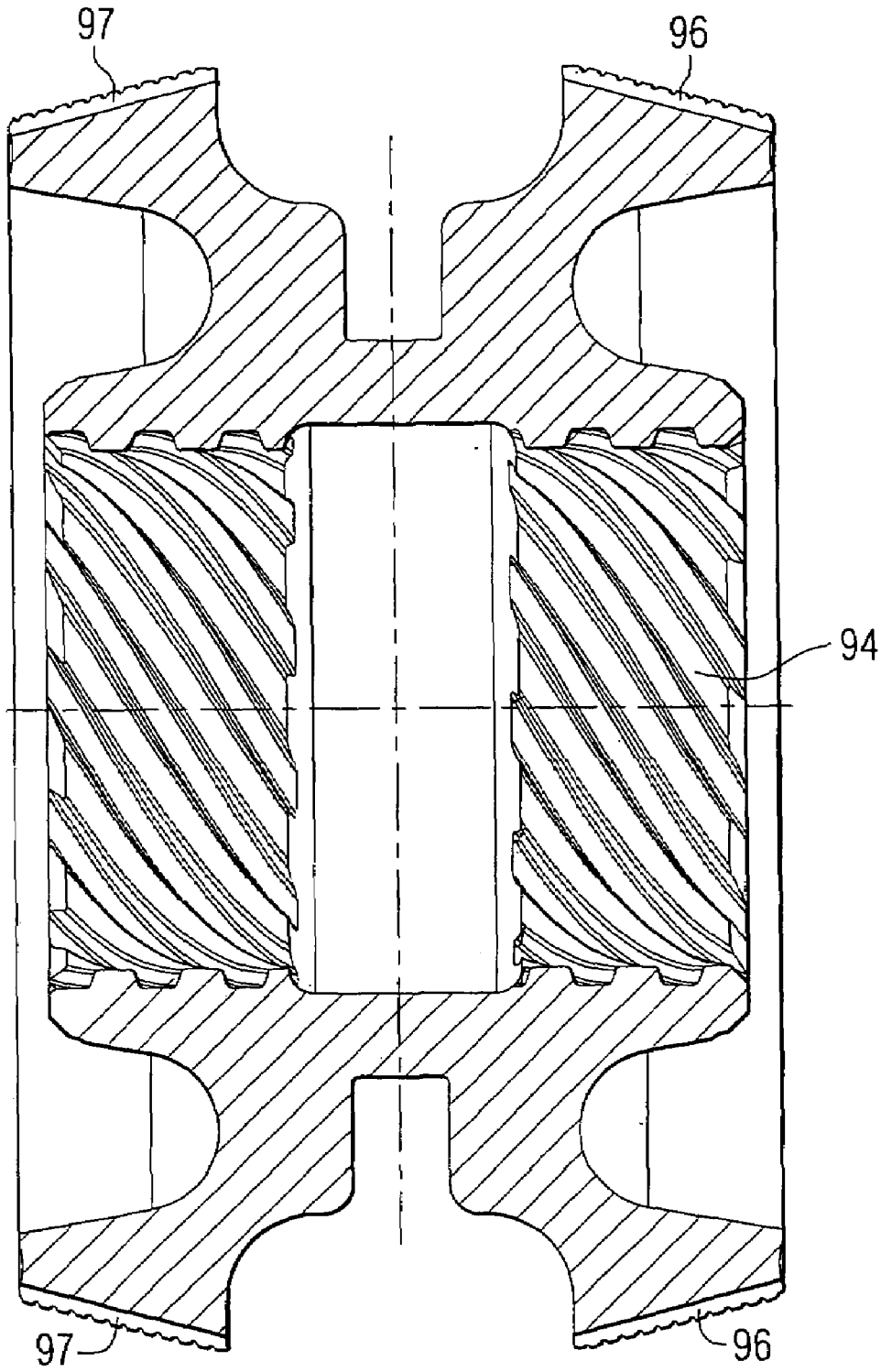
FIG. 10 shows a cone clutch used in a preferred embodiment of the present invention.

FIG. 9A shows an intermediate shaft 90 and FIG. 9B shows a section view of the same intermediate shaft 90. The intermediate shaft 90 is a component used in a transmission made in accordance with a preferred embodiment of the present invention. FIG. 10 illustrates a section view of a clutch 60 which is a component used in a preferred embodiment of the present invention. These two individual components work together to create a torque transmitting association between the clutch 60 and the second shaft 42, or driven shaft, described above. The intermediate shaft 90 and the clutch 60, which are illustrated individually in FIGS. 9A, 9B and 10, will also be described in conjunction with FIG.

11 in which these two individual components are assembled with other components in an embodiment of the present invention.

With continued reference to FIG. 9, a central portion 91 of the intermediate shaft 90 is provided with a helical spline, which in a preferred embodiment comprises a 12-start involute thread, that is also referred to as a helical spline. At one end 92, the intermediate shaft 90 is shaped to be received in sliding association within the structure of the first bevel gear 71. This allows the intermediate shaft 90 to rotate relative to the first bevel gear 71 which is rigidly attached to the first shaft 71. The other end 93 of the intermediate shaft 90 is splined. The splined end 93 allows the intermediate shaft 90 to be coupled to a tail stock shaft of the transmission. This also facilitates the connection between the tail stock shaft and the second shaft 42 which is described above.

With reference to FIG. 10, the clutch 60 has an internally splined portion 94 that is threaded to mate with the threads 91 of the intermediate shaft 90. A first frictional surface 96 is shaped to move into mating association with a frictional surface of the first bevel gear 71. A second frictional surface 97 is shaped to move into frictional engagement with a frictional surface of the second bevel gear 72. As described above, when either of the two frictional surfaces, 96 or 97, of the clutch 60 begin to contact their associated mating frictional surfaces of the first or second bevel gears, 71 or 72, the resistance to rotation by the second shaft 42, in combination with the threaded engagement of the helical splines, 91 and 94, further urge the contacting frictional surface, 96 or 97, into more intimate frictional contact with the associated frictional surface of the first or second bevel gears, 71 or 72. In this way, torque is transmitted through the clutch 60.

Figure 11:
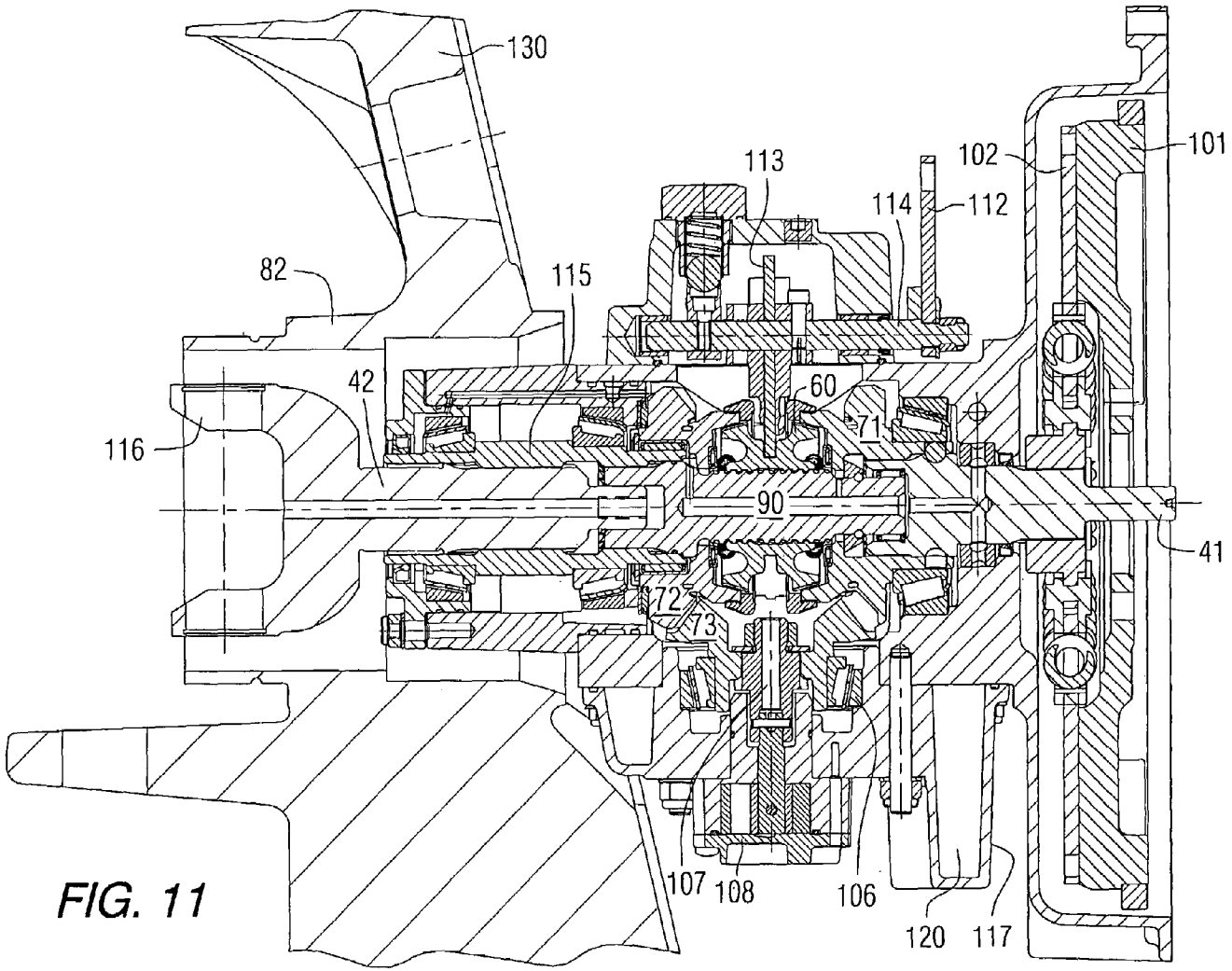
FIG. 11 is a section view of a transmission incorporating the principles of the present invention.

FIG. 11 is a section view of a transmission incorporating the basic principles of the present invention. Reference numeral 101 identifies a flywheel of an internal combustion engine and reference numeral 102 is the spring flex plate that is mounted to the flywheel 101. The flex plate 102 acts as a torsional damper for the transmission. The flex plate is torsionally keyed to the input shaft 41, or driving shaft. The smaller protrusion (extending to the right) shown on the input shaft 41 is a pilot that protrudes into the end of the engine crankshaft and maintains it in a coaxial position with the crankshaft. The first shaft 41, or driving shaft, is also splined at its opposite end to the first bevel gear 71. A portion of the first bevel gear 71 is a female cone clutch socket which is described above and more simply illustrated in FIGS. 6–8. The first bevel gear 71 meshes with the intermediate gear 73. The intermediate bevel gear 73 is supported by bearing 106.

Splined to the bore of the intermediate bevel gear 73 is a pump drive shaft 107 that, in turn, drives a gerotor pump 108. Intermediate bevel gear 73 also meshes with the second bevel gear 72, which operates as a reverse bevel gear. Located between the first bevel gear 71 and the second bevel gear 72 is the clutch 60 which has a male frictional cone surface on both sides. These two male cone frictional surfaces are described above and identified by reference numerals 96 and 97. The clutch 60 can engage with mating frictional sockets that are formed in the first and second bevel gears, 71 and 72. The clutch 60 is connected to the intermediate shaft 90 through a helical spline arrangement which comprises the helical splines 91 and 94 which are described above in conjunction with FIGS. 9 and 10.

With continued reference to FIG. 11, a shift lever 113 is a fork-shaped shifting yoke that fits in a slot on the outside diameter of the clutch 60. A lever 112 is fixed to a shift shaft 114. The shift shaft 114 has a ramp, or cam, on the sides of its fork that engages with the shift lever 113.

The friction created between the conical frictional surfaces begins to turn the cone clutch 60 relative to the intermediate shaft 90. Because of the helical spline mating association between the splines 94 of the clutch 60 and the splines 91 of the intermediate shaft 90, the clutch 60 is pulled more tightly toward the first bevel gear 71. This is caused by the inertial resistance to rotation initially provided by the second shaft 42 as the input shaft 41 continues to rotate the first bevel gear 71. Higher torque transferred through the intermediate shaft 90 causes a higher clamping load to be generated between the mating frictional clutch surfaces. It should be noted that, when in forward gear position, torque is transmitted through the first bevel gear 71 to the clutch 60 and to the intermediate shaft 90, to the tail stock shaft 115 and to the U-joint 116 of the second shaft 42. Very little torque is transmitted through the gears, 71–73, other than the small amount of torque used to drive the gerotor pump 108.

With continued reference to FIG. 11, reverse gear connection is engaged by moving the clutch 60 toward the second bevel gear 72 until contact is made between the mating clutch surfaces. Torque is transmitted from the first bevel gear 71 to the intermediate bevel gear 73 and to the second bevel gear 72. It is then transmitted to the clutch 60, to the intermediate shaft 90, to the tail stock shaft 115, and to the U-joint 116 of the second shaft 42. Because of the helical spline relationship between the intermediate shaft 90 and the clutch 60, increased torque transmitted through the cone clutch increases the contact force between the clutch faces.

Another advantage provided by the present invention is the reduction in windage losses. A return sump 120 is located below all of the rotating bearings and gears. The gerotor pump 108 draws oil from the sump 120 which is located in the cover 117 and pressure induces the oil to flow to all critical rotating components. The system is designed so that the oil flows back to the sump 120 to minimize contact with the rotating components and, as a result, reduce windage losses.

With continued reference to FIG. 11, the outer transom housing 130 of a marine propulsion system is illustrated. As can be se en, the transmission provided by the present invention is forward of the transom and the drive unit 82 is aft of the outer transom housing 130.

With reference to FIGS. 6–11, it can be seen that the present invention provides a first shaft 41, or driving shaft, supported for rotation about a first axis 51. A second shaft 42, or driven shaft, is supported for rotation about a second axis 52. A clutch 60 is alternately moveable into a first position, shown in FIG. 6, and a second position shown in FIG. 7. The first position disconnects the clutch 60 from torque transmitting association with the first and second shafts, 41 and 42, and also disconnects the first and second shafts from torque transmitting relation with each other. The second position connects the clutch 60 in torque transmitting association between the first and second shafts, 41 and 42, with torque being transferred from the first shaft 41 to the second shaft 42 solely through the clutch 60. A first bevel gear 71 is attached to the first shaft 41 and rotatable about the first axis 51. A second bevel gear 72 is rotatable about a second axis 52. An intermediate bevel gear 73 is disposed in gear tooth meshing association between the first and second bevel gears, 71 and 72. The clutch 60 is alternately moveable into a third position, illustrated in FIG. 8, in which the clutch

60 is connected in torque transmitting association between the second bevel gear 72 and the second shaft 42. The first and second shafts, 41 and 42, are then connected in torque transmitting relation with each other through the first bevel gear 71, the intermediate bevel gear 73, the second bevel gear 72, and the clutch 60 when the clutch is in the third position shown in FIG. 8. The first and second axes, 51 and 52, are generally parallel to each other and, in a preferred embodiment, are coaxial with each other. The intermediate bevel gear 73 is rotatable about a third axis 53 which is generally perpendicular to the first and second axes, 51 and 52. The first shaft 41 is connected in torque transmitting relation with a crankshaft of an engine 80. The second shaft 42 is connected in torque transmitting relation with a propeller shaft 86. The clutch 60 is connected in threaded engagement with the second shaft 42 through a set of helical splines, 91 and 94. The clutch 60, in a preferred embodiment of the present invention, is a cone clutch.

Although the present invention has been described with particular detail and illustrated to show specific embodiments, it should be understood that alternative embodiments are also within its scope.

We claim:

1. A transmission for a marine propulsion system, comprising:

a first shaft supported for rotation about a first axis;

a second shaft supported for rotation about a second axis, said first and second axes being generally parallel with each other; and a clutch which is alternately movable into first position and second positions, said first position disconnecting said clutch from torque transmitting association with said first and second shafts and disconnecting said first and second shafts from torque transmitting association with each other, said second position connecting said clutch in torque transmitting association between said first and second shafts with torque being transferred from said first shaft to said second shaft solely through said clutch.

2. The transmission of claim 1, further comprising:

a first gear attached to said first shaft and rotatable about said first axis;

a second gear which is rotatable about said second axis; and an intermediate gear disposed in gear tooth meshing association between said first and second gears.

3. The transmission of claim 2, wherein:

said first gear is a bevel gear;

said intermediate gear is a bevel gear;

said second gear is a bevel gear; and said clutch is alternately movable into a third position, said third position connecting said clutch in torque transmitting association between said second bevel gear and said second shaft, said first and second shafts being connected in torque transmitting association with each other through said first bevel gear, said intermediate bevel gear, said second bevel gear, and said clutch when said clutch is in said third position.

4. The transmission of claim 1, wherein:

said first and second axes are coaxial with each other.

5. The transmission of claim 3, wherein:

said intermediate bevel gear is rotatable about a third axis which in generally perpendicular to said first and second axes.

6. The transmission of claim 1, wherein:

said first shaft is connected in torque transmitting association with a crankshaft of an engine.

7. The transmission of claim 1, wherein:

said second shaft is connected in torque transmitting association with a propeller shaft.

8. The transmission of claim 1, wherein:

said clutch is connected in threaded engagement with said second shaft through a set of helical splines.

9. The transmission of claim 1, wherein:

said clutch is a cone clutch.

10. A transmission for a marine propulsion system, comprising:

a driving shaft supported for rotation about a first axis;

a driven shaft supported for rotation about a second axis, said first and driven shafts being generally coaxial with each other; and a clutch which is alternately movable into first position and second positions, said first position disconnecting said clutch from torque transmitting association with said first and driven shafts and disconnecting said first and driven shafts from torque transmitting association with each other, said second position connecting said clutch in torque transmitting association between said first and driven shafts with torque being transferred from said driving shaft to said driven shaft solely through said clutch.

11. The transmission of claim 10, further comprising:

a first bevel gear attached to said driving shaft and rotatable about said first axis;

a second bevel gear which is rotatable about said second axis; and an intermediate bevel gear disposed in gear tooth meshing association between said first and second bevel gears.

12. The transmission of claim 11, wherein:

said clutch is alternately movable into a third position, said third position connecting said clutch in torque transmitting association between said second bevel gear and said driven shaft, said first and driven shafts being connected in torque transmitting association with each other through said first bevel gear, said intermediate bevel gear, said second bevel gear, and said clutch when said clutch is in said third position.

13. The transmission of claim 12, wherein:

said first and second axes are generally parallel with each other.

14. The transmission of claim 12, wherein:

said first and second axes are coaxial with each other.

15. The transmission of claim 10, wherein:

said intermediate bevel gear is rotatable about a third axis which in generally perpendicular to said first and second axes.

16. The transmission of claim 10, wherein:

said driving shaft is connected in torque transmitting association with a crankshaft of an engine;

said driven shaft is connected in torque transmitting association with a propeller shaft; and said clutch is connected in threaded engagement with said driven shaft through a set of helical splines, said clutch being a cone clutch.

17. A transmission for a marine propulsion system, comprising:

a driving shaft supported for rotation about a first axis;

a driven shaft supported for rotation about a second axis, said first and driven shafts being generally coaxial with each other;

a cone clutch which is alternately movable into first position and second positions, said first position disconnecting said cone clutch from torque transmitting association with said first and driven shafts and disconnecting said first and driven shafts from torque transmitting association with each other, said second position connecting said cone clutch in torque transmitting association between said first and driven shafts with torque being transferred from said driving shaft to said driven shaft solely through said cone clutch;

a first bevel gear attached to said driving shaft and rotatable about said first axis;

a second bevel gear which is rotatable about said second axis; and an intermediate bevel gear disposed in gear tooth meshing association between said first and second bevel gears.

18. The transmission of claim 17, wherein:

said cone clutch is alternately movable into a third position, said third position connecting said cone clutch in torque transmitting association between said second bevel gear and said driven shaft, said first and driven shafts being connected in torque transmitting association with each other through said first bevel gear, said intermediate bevel gear, said second bevel gear, and said cone clutch when said cone clutch is in said third position, said first and second axes being generally coaxial with each other, said driving shaft being connected in torque transmitting association with a crankshaft of an engine, said driven shaft being connected in torque transmitting association with a propeller shaft, said cone clutch being connected in threaded engagement with said driven shaft through a set of helical splines, said cone clutch being a cone clutch.

19. The transmission of claim 18, wherein:

said intermediate bevel gear is rotatable about a third axis which in generally perpendicular to said first and second axes.

* * * * *